United States Patent [19]

Bammert

[11] 3,937,592

[45] Feb. 10, 1976

[54] MULTI-STAGE AXIAL FLOW COMPRESSOR

[75] Inventor: Karl Bammert, Hannover, Germany

[73] Assignee: Gutehoffnungshutte Sterkrade Aktiengesellschaft, Germany

[22] Filed: Feb. 24, 1975

[21] Appl. No.: 552,219

Related U.S. Application Data

[63] Continuation-in-part of Ser. No. 365,583, May 30, 1973, abandoned.

[52] U.S. Cl. ..... 415/194; 415/198 R

[51] Int. Cl.[2] ..... F04D 19/00; F04D 19/02

[58] Field of Search ..... 415/194, 198

[56] References Cited

UNITED STATES PATENTS

| | | | |
|---|---|---|---|
| 1,601,614 | 9/1926 | Fleming | 415/194 |
| 2,234,733 | 3/1941 | Jendrassik | 415/DIG. 1 |
| 2,313,413 | 3/1943 | Weske | 415/193 |
| 2,314,572 | 3/1943 | Chitz | 415/DIG. 1 |
| 2,406,126 | 8/1946 | Zweifel | 415/194 |
| 3,112,866 | 12/1963 | Fortescue | 415/194 |
| 3,723,021 | 3/1973 | Bartholomew | 415/147 |

FOREIGN PATENTS OR APPLICATIONS

| | | | |
|---|---|---|---|
| 479,427 | 1/1938 | United Kingdom | 415/194 |
| 667,611 | 3/1952 | United Kingdom | 415/194 |
| 969,683 | 5/1950 | France | 415/194 |
| 430,569 | 3/1947 | Italy | 415/194 |

*Primary Examiner*—Henry F. Raduazo
*Attorney, Agent, or Firm*—McGlew and Tuttle

[57] ABSTRACT

A multi-stage axial flow turbine and blast furnace compressor blower comprises a blower having a degree of reaction of 100% and which includes a rotatable shaft having a plurality of rings with blades defining moving blade rows arranged in spaced location with a plurality of guide blade rows. The construction includes a plurality of stages between an initial and a final stage which include a moving ring with two relative moving blades and a single guide blade row. The initial and final stages are arranged so that the stages include either an initial single moving blade row and a final stage consisting of a single guide blade row and a single moving blade row or the initial stage comprises a single guide blade row and a moving ring with two rows of blades and the final stage comprises a single guide blade row. The construction makes it possible to foreshorten the shaft by providing one row of the guide blade blades to take up the pressure of two rows of the moving blades at 100% reaction between said initial stage and said final stage.

4 Claims, 5 Drawing Figures

MULTI-STAGE AXIAL FLOW COMPRESSOR

REFERENCE TO OTHER APPLICATION

This application is a continuation-in-part of application Ser. No. 365,583 filed May 30, 1973, now abandoned.

BACKGROUND OF THE INVENTION

1. Field of the Invention

This invention relates in general to the construction of turbo-compressors and, in particular, to a new and useful multi-stage axial flow compressor which is provided with individual stages which include a runner combination and a guide wheel.

2. Description of the Prior Art

The invention provides a multistage axial flow compressor having a degree of reaction or percentage reaction of approximately 100%. Each compressor stage comprises a tandem cascade formed by two consecutively arranged rotor blade rings and a single guide blade ring. A so-called tandem cascade is a compressor stage which comprises two consecutively arranged rings of rotor blades or a rotor wheel which carries two consecutively arranged blade rings and a guide blade ring adjacent these rings.

By the inventive arrangement of the stages between the initial stage and the final stage with each stage including a moving ring with two rows of moving baldes in a single guide blade row there is a vast improvement over the construction of the prior art wherein a single row of rotor blades and a single row of guide blades are employed inasmuch as the guide blade ring is saved in each stage while obtaining the same circumferential effect. With such a construction it is therefore possible to reduce the entire blading by approximately 45% and the bladed overall length by approximately 30% so that the length of the rotor shaft can also be correspondingly shortened.

Another advantage of the present construction in contrast to the prior art is that the inlet and outlet wheels may be omitted so that the blading expenditures may be further reduced and the overall length may be shortened in addition. A substantial advantage is obtained with compressors having stages of this construction because they are less sensitive to changes of the outflow angle. This leads to a substantially more favorable behavior in the part load duty range so that due to a relatively flat characteristic curve of operation, a considerably wider characteristic field is available.

A further advantage of the invention has been found by testing such an arrangement employing two rotor blade rows and a guide blade row where it has been shown that an extraordinarily favorable effect on the secondary and tip clearance losses is obtained so that a basic improvement of the internal efficiency of the compressor can be obtained. With such a construction in a single stage axial blower the location of the surge limit can be favorably influenced.

By constructing the stages between the initial and final stage so that it comprises a plurality of stages each including a moving ring with two rows of moving blades and a single guide blade row in a compressor having a percentage reaction of about 100%, a considerable load reserve is present in the guide blade rows. Thus with the compressors having a percentage reaction of 100% almost the entire deflecting work is made by the rotor blade rows so that the guide blade rows are relieved to an extraordinary degree. This condition however applies only to axial flow compressors having a percentage reaction of substantially 100%.

Accordingly it is an object of the invention to provide a multistage axial flow turbine and blast furnace compressor blower which comprises a compressor having a reaction of 100% and with a rotatable shaft having a plurality of rings with blades defining moving blade rows interspersed with a plurality of guide blade rows and wherein the rows are arranged in a plurality of intermediate stages between an initial stage and a final stage and with the intermediate stages each including a moving ring with two rows of moving blades and a single guide blade row and the initial stage comprising at least one of the following: a single moving blade row or a single guide blade row in a moving ring with two rows of blades and the final stage comprising either: a single guide blade row and a single moving blade row or a single guide blade row, and wherein the shaft is foreshortened by providing one row of the guide blades to take up the pressure of two rows of the moving blades in the intermediate stages at 100% reaction between said initial and said final stages.

A further object of the invention is to provide a multi-stage axial flow compressor which is simple in design, rugged in construction and economical to manufacture.

For an understanding of the principles of the invention, reference is made to the following description of typical embodiments thereof as illustrated in the accompanying drawing.

GENERAL DESCRIPTION OF PREFERRED EMBODIMENTS

Figure 1:
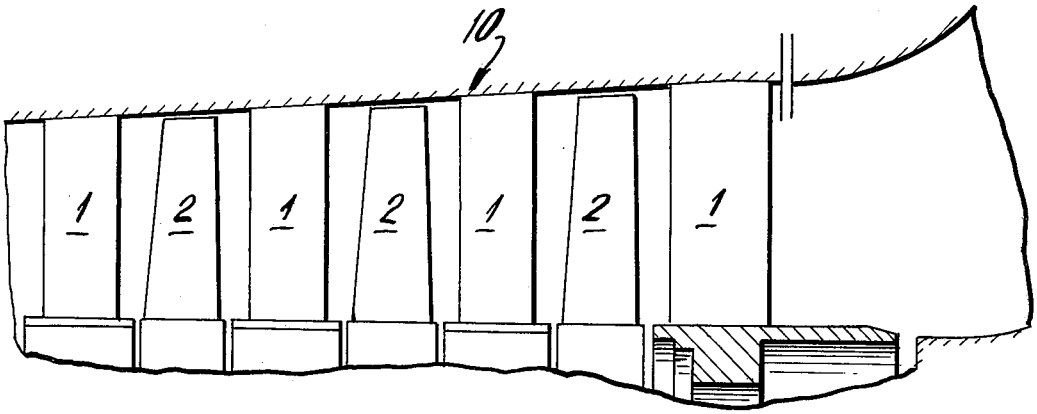
(PRIOR ART) FIG.1
FIG. 1 is a schematic axial view of a conventional axial flow compressor showing the arrangement of runners and guide wheels in accordance with the prior art.
Figure 3:
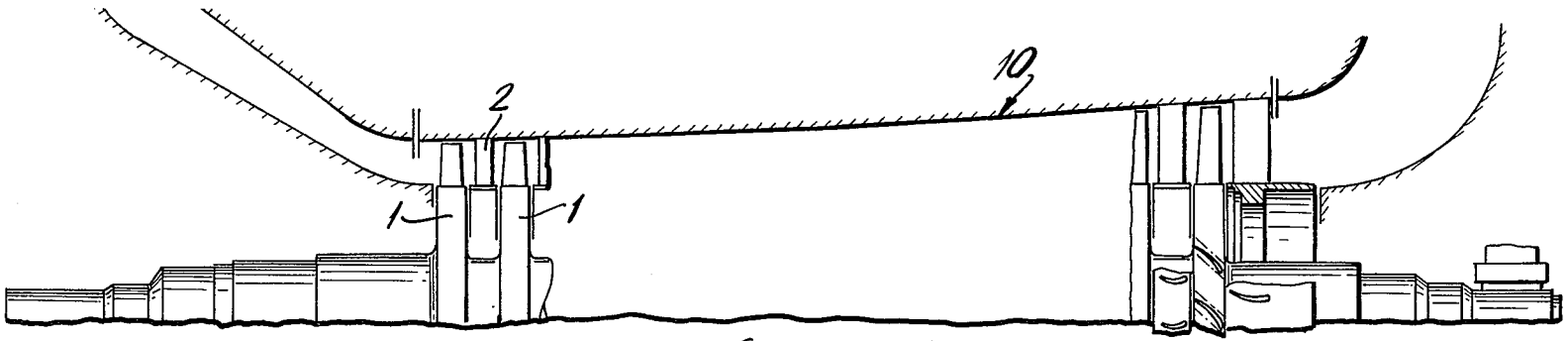
(PRIOR ART) FIG.3
FIG. 3 is an axial cross sectional view, partly schematic, showing the blade structure in accordance with the prior art.

Referring to the drawing in particular, the invention embodied therein is an improvement over the prior art which is shown in FIGS. 1 and 3. The conventional compressor comprises an arrangement of guide wheels 1 and runners 2 in which the guide wheels and the runners are in alternate order proceeding axially.

Figure 2:
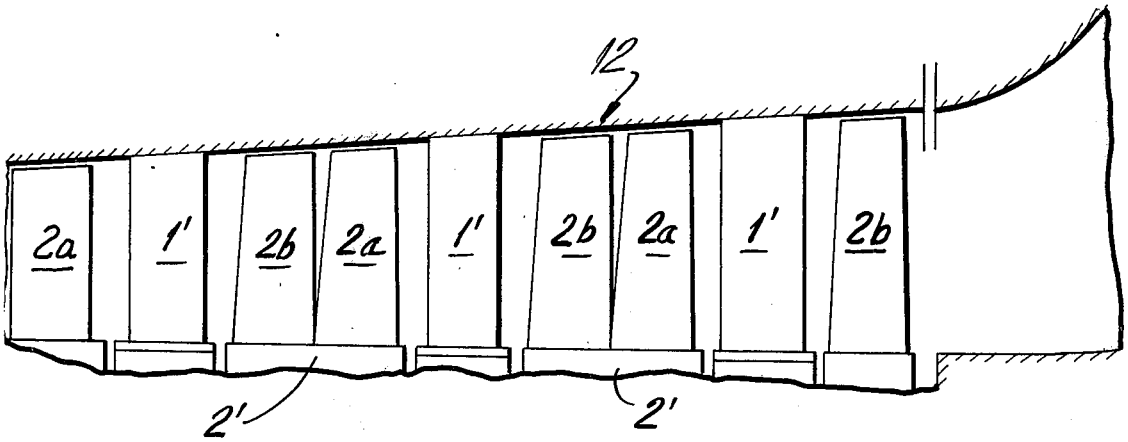
FIG. 2 is a view similar to FIG. 1 showing an axial flow compressor constructed in accordance with the invention.
Figure 4:
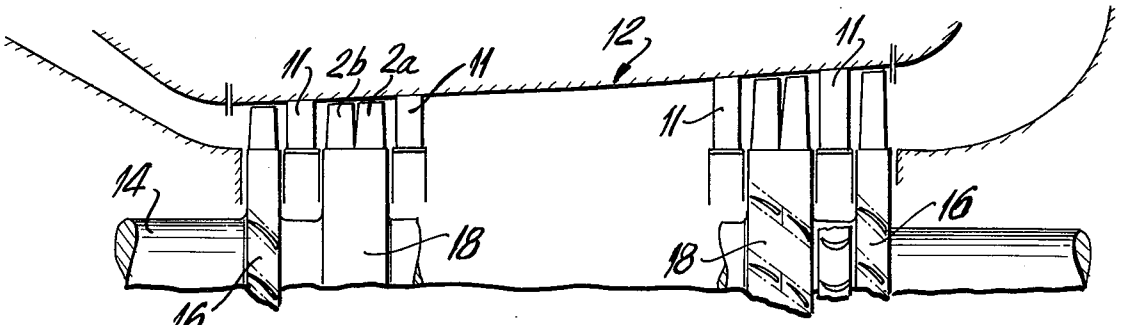
FIG. 4 is an axial sectional view showing only the blade structures at each end of the embodiment shown in FIG. 2.

In accordance with the invention, as shown in FIGS. 2 and 4, every second guide wheel 1' is omitted and instead there is a runner combination 2' between the guide wheels 1', 1' which comprises successive runners **2*a* and 2*b*. The runners 2*a* and 2*b* are constructed such that at least the same pressure ratio is achieved as with the two stages in the conventional arrangement shown in FIG. 1. The invention is particularly suitable for a stage design where the percentage reaction is 100%. In such a situation the flow from the guide wheels 1'** have to effect a higher deflection than is in FIG. 1.

The design of the stages is applicable to a percentage reaction of 100%, and at much lower reactions such as at a percentage reaction of 50% the guide wheels 1 slow down the flow in addition to the altering of the direction of flow. The degree of reaction is taken as the ratio of the pressure drop across the rotor in respect to the pressure drop across the stage.

As shown in FIG. 2 with the inventive arrangement a plurality of repetition or intermediate stages are arranged between an initial stage and a final stage. Each of the repetition stages comprises a single ring 1′ of guide blades and a rotor wheel carrying two consecutive rings of rotor blades 2*a* and 2*b* in a tandem cascade arrangement on the associated shaft 2′. Each intermediate or repetition stage is arranged so that a guide blade ring 1′ is followed by a double row rotor wheel 2*a* and 2*b*.

Figure 5:
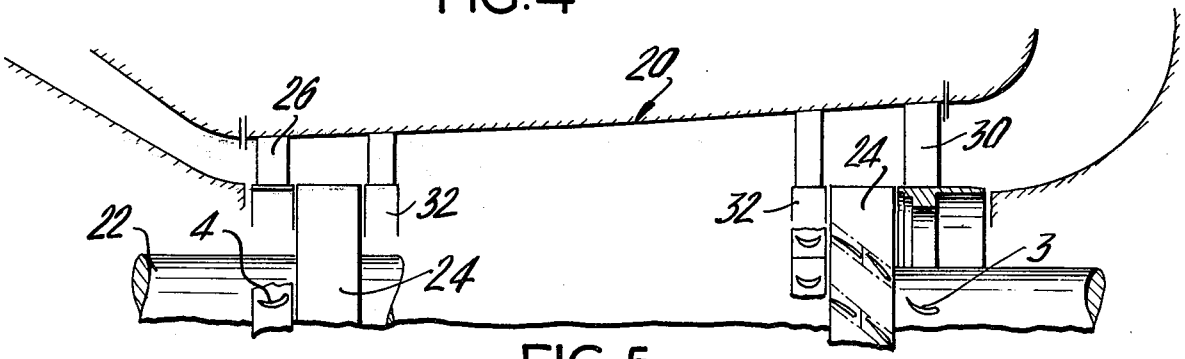
FIG. 5 is a view similar to FIG. 4 of another embodiment of the invention.

While in the embodiment of FIG. 2 the initial stage comprises only a single rotor wheel 2*b* and a single guide blade row 1 the final stage comprises a single row guide ring 2*a* the arrangement in FIG. 5 is modified thereover.

A comparison of the invention with references to FIGS. 3 and 4 indicates that a turbo-compressor 12 constructed in accordance with the invention can be constructed with a length which is considerably shorter than the length required for the prior art turbo-compressor 10. The turbo-compressot 12 includes a rotatable shaft 14 carrying runners 16 and combination runners 18. In the embodiment shown in FIG. 4, there is no initial and slowing down guide wheel at the respective ends of the stages but, instead the runners 16 are arranged at each end. The combination runners 18 include the blade rings 2*a* and 2*b* and are identical with those schematically indicated at 2′ in FIG. 2. Similarly the guide wheels designated 11 in FIG. 4, are identical with the guide wheels 1′ shown in FIG. 2.

In the embodiment shown in FIG. 5 there is provided a turbo-compressor generally designated 20 which includes a shaft 22 which carries a runner combination 24 directly adjacent guide wheels 26. In this embodiment an initial guide wheel 26 is located at the entrance end and a single guide wheel 30 is located at the opposite end and comprises a slowing down guide wheel. The blades of the guide wheel 26 are schematically indicated at 4 and those of the guide wheel 30 are schematically indicated at 3. In the turbo-compressor 20 of FIG. 5 only combined runners 24 are employed after each axially adjacent guide wheel 32.

In the embodiment of FIG. 5 the initial stage comprises the single row guide ring 3 or inlet ring and the double row rotor wheel 24 which comprises a tamden cascade. Thereafter there follows the first intermediate or repetition stage and the final stage comprises only a single row guide ring 4 or outlet ring.

In both the arrangements of FIGS. 4 and 5 the structural length of the turbines 12 and 20 can be reduced to one third of the length of the conventional design of the prior art shown in FIG. 3. The embodiment shown in FIG. 5 is more suitable for achieving a broad performance characteristic since a better adjustment to the necessary operating conditions can be achieved by the initial setting of the guide wheel 26 which is located before the first runner combination 24. The disadvantage of using only one profile in the control of the guide blades is that although the angle of incidence onto the following runner can be maintained independently of the throughput volume, the angles of incidence onto the preceding and the following guide wheels are changed. The change of the angle of incidence can be avoided by using guide wheel combination of which only the second row of blades is adjusted. The second row of blades is insensitive to the changes of the oncoming flow.

An especially important characteristic is that the guide blades are adjusted between runners in the classical manner according to the principle of achieving the highest possible constancy for the angle of incidence of the runner over the entire range of operation. With the inventive construction the guide blades are more sensitive to changes in the angle of incidence than the combined runner stages. Accordingly, the guide wheels must be adjustable in such a manner that the angle of incidence of flow into the guide wheel is constant over the entire range of operation.

While specific embodiments of the invention have been shown and described in detail to illustrate the application of the principles of the invention, it will be understood that the invention may be embodied otherwise without departing from such principles.

What is claimed is:

1. A multistage axial compressor comprising a rotatable shaft having a plurality of rings with blades defining moving blade rows interspersed with a plurality of guide blade rows, said rows being arranged in an initial and a final stage with a plurality of intermediate stages between said initial and said final stage, each intermediate stage including a moving ring with two rows of moving blades and a single guide blade row, said initial and final stages comprising an initial stage with a single guide blade row and a moving ring with two rows of blades and a final stage comprising a single guide blade row, said shaft being foreshortened by providing one row of said guide blades to take up the pressure of two rows of said moving blades at 100% reaction between said initial stage and said final stage.

2. A multistage axial compressor according to claim 1, wherein said guide wheels are adjusted so that their angle of incidence of flow is constant over the entire range of operation.

3. A multistage axial compressor according to claim 1, wherein said guide wheels are provided with two blade profiles.

4. A multistage axial flow turbine in a blast furnace compressor blowing engine having a degree of reaction of 100%, comprising a rotatable shaft having a plurality of rings and blades defining moving blade rows interspersed with a plurality of guide blade rows, said moving and guide blade rows being arranged with an initial and a final stage and an intermediate stage between the initial and final stage which includes a plurality of separate stage portions each having a moving ring with two rows of moving blades and a single guide blade row, said initial stage comprising a single moving blade row and a single guide blade row, said final stage comprising a single moving blade row, said shaft being foreshortened by having said intermediate stages constructed with said one row of guide blades taking up the pressure of two rows of said moving blades at 100% reaction between said initial stage and said final stage.

* * * * *